US005984698A

United States Patent [19]

Hirata

[11] Patent Number: 5,984,698

[45] Date of Patent: Nov. 16, 1999

[54] CONNECTOR ASSEMBLY HAVING SIGNAL AND GROUND TERMINALS

[75] Inventor: Hideyuki Hirata, Yokohama, Japan

[73] Assignee: Molex Incorporated, Lisle, Ill.

[21] Appl. No.: 09/032,210

[22] Filed: Feb. 27, 1998

[30] Foreign Application Priority Data

Mar. 7, 1997 [JP] Japan ..... 9-070460

[51] Int. Cl.[6] ..... H01R 3/00

[52] U.S. Cl. ..... 439/101; 439/607

[58] Field of Search ..... 439/101, 497, 439/606, 607, 608, 609, 610

[56] References Cited

U.S. PATENT DOCUMENTS

| | | | |
|---|---|---|---|
| 5,288,247 | 2/1994 | Kaufman | 439/607 |
| 5,399,105 | 3/1995 | Kaufman et al. | 439/609 |
| 5,441,425 | 8/1995 | Kitamura | 439/620 |
| 5,470,259 | 11/1995 | Kaufman et al. | 439/607 |
| 5,473,109 | 12/1995 | Plankl et al. | 174/35 C |
| 5,478,260 | 12/1995 | Kaufman et al. | 439/609 |
| 5,688,130 | 11/1997 | Huang | 439/79 |
| 5,795,190 | 8/1998 | Ono | 439/607 |
| 5,807,137 | 9/1998 | Janota et al. | 439/607 |

FOREIGN PATENT DOCUMENTS

WO 94/22182 9/1994 European Pat. Off. .

*Primary Examiner*—Lincoln Donovan
*Attorney, Agent, or Firm*—Stacey E. Caldwell

[57] ABSTRACT

An improved electrical connector assembly for mounting to a printed circuit board (6) and for receiving a PC card. The electrical connector assembly includes a housing (3) having signal terminals (1) and ground terminals (2), wherein the tail portions (11) of the signal terminals are of surface mount type and the tail portions (21) of the ground terminals are of through-hole type. The tail portions of the ground terminals extend in at least one row toward the circuit board between the tail portions of the signal terminals and the rear end of the housing. In this configuration, the signal terminal tail portions and the ground terminal tail portions can be simultaneously soldered and all of the solder joints can be inspected without obstruction, the surface mount solder joints inspected from an upper surface (7) of the circuit board and the through-hole solder joints can be inspected from a lower surface (8) of the circuit board. The ground terminals, in the form of a unitary ground shield, are positioned on an upper surface of the housing (3).

4 Claims, 3 Drawing Sheets

CONNECTOR ASSEMBLY HAVING SIGNAL AND GROUND TERMINALS

BACKGROUND OF THE INVENTION

1. Field of the Invention

The present invention relates generally to an electrical connector assembly. More specifically, the invention relates to an electrical connector assembly having signal and ground terminals for mounting on a printed circuit board.

2. Description of the Related Art

Electrical connector assemblies having signal and ground terminals for mounting on printed circuit boards are used and known in PC card and Cardbus applications. These electrical connector assemblies typically include a housing provided with both signal and ground terminals wherein each of the signal and ground terminals includes a mating end having contact portions adapted for contacting portions of the card and a mounting end with tail portions adapted to be solder connected to conductors on an underlying printed circuit board.

Previously, the tail portions of the signal and ground terminals were both of the dip-soldering type, that is, the tail portions were adapted to be inserted into through-holes in the printed circuit board and then soldered. More recently however, due to the miniaturization and high density requirements of electrical connectors in general, the tail portions of the signal and ground terminals are known to be of the surface soldering type, that is, the tail portions are adapted to be soldered to the surface of the printed circuit board.

In known electrical connector assemblies having signal and ground terminals, the tail portions of the signal and ground terminals are typically aligned in two rows at the rear of the housing. Since each of the tail portions of both the signal and ground terminals is soldered to the conductor on the printed circuit board at the rear of the housing, it is difficult to inspect (and correct if necessary) the solder joints of the tail portions located in the more inner row due to visibility and accessibility.

During assembly of such an electrical connector assembly, and during mounting of the connector to its underlying circuit board, the ground terminals are typically not integral with the housing. The ground terminal is often in the form of a ground shield and is separate from the housing. The housing, initially provided with signal terminals only, is mounted on the printed circuit board, and the tail portions of the signal terminals are soldered and the solder joints inspected. Next, the ground terminal or shield is mounted on the soldered connector assembly and the tail portions of the ground terminal are soldered and the solder joints inspected. At this point, the electrical connector assembly, including the signal and ground terminals, is mounted on and soldered to the printed circuit board and all the solder joints are inspected.

According to the above-mentioned prior art, the electrical connector assembly is mounted on the printed circuit board in a two-step process. First, the housing with the signal terminals is mounted on and soldered to the printed circuit board. Then, the ground terminal is mounted on the housing and soldered to the circuit board. This two-step assembly therefore limits the productivity and efficiency of the assembly and mounting of the electrical connector assembly to the printed circuit board.

SUMMARY OF THE INVENTION

Therefore, the object of the present invention is to provide an electrical connector assembly having both signal and ground terminals which facilitates inspection of the solder joints of the tail portions of both sets of terminals after soldering to the printed circuit board, thereby resulting in improved productivity and efficiency of mounting the electrical connector assembly to the printed circuit board.

The present invention comprises an electrical connector assembly for mounting on a printed circuit board comprising:

a housing having signal terminals and ground terminals;

each of the signal terminals including a surface mount tail portion including an extending portion extending from a rear end of said housing and a mounting portion for surface attachment to the printed circuit board, wherein the mounting portions are positioned in at least one row;

each of the ground terminals including a through-hole tail portion including an extending portion extending toward a surface of said printed circuit board and a mounting portion extending through a hole in the printed circuit board, wherein the extending portions of the ground terminals are positioned between said extending portions of said signal terminals, and said tail portions of said ground terminals are positioned in at least one single row between said tail portions of said signal terminals and said rear end of said housing.

The present invention thus solves the problems of the prior art by providing a connector assembly with signal terminals having surface mount tail portions and ground terminals having dip soldered or through-hole tail portions. The tail portions of the ground terminals are positioned between the tail portions of the signal terminals and the rear end of the housing. Therefore, the tail portions of the signal terminals are positioned outside or rearward of the tail portions of the ground terminals so that inspection of the solder joints of the surface mount tail portions of the signal terminals is facilitated. Furthermore, since the tail portions of the ground terminals are dip soldered or through-hole type, inspection of the solder joints of the through-hole tail portions of the ground terminals is performed on an opposite or underside of the printed circuit board. Therefore, inspection of the solder joints of the through-hole tail portions of the ground terminals is also facilitated.

Furthermore, the ground terminals or ground shield is mounted on an upper portion of the housing, rather than from the rear end of the housing in prior art connectors. Therefore, mounting and assembling the electrical connector to the printed circuit board can be more easily automated and therefore the productivity and efficiency of mounting the electrical connector assembly to the printed circuit board is further improved.

BRIEF DESCRIPTION OF THE DRAWINGS

The present invention will be understood more fully from the detailed description given below and from the accompanying drawings of the preferred embodiment of the invention, which, however, should not be taken to limit the present invention, but are for explanation and understanding only.

Accordingly, in the drawings.

DESCRIPTION OF THE PREFERRED EMBODIMENT

The present invention will be discussed in detail below according to the preferred embodiments and with reference to the accompanying drawings. In the following description, numerous specific details are set forth in order to provide a thorough understanding of the present invention. It will be obvious to those skilled in the art that the present invention may be practiced without these specific details. Note that in some instances, known structures are not shown in detail so as to not unnecessarily obscure the present invention.

Figure 1:
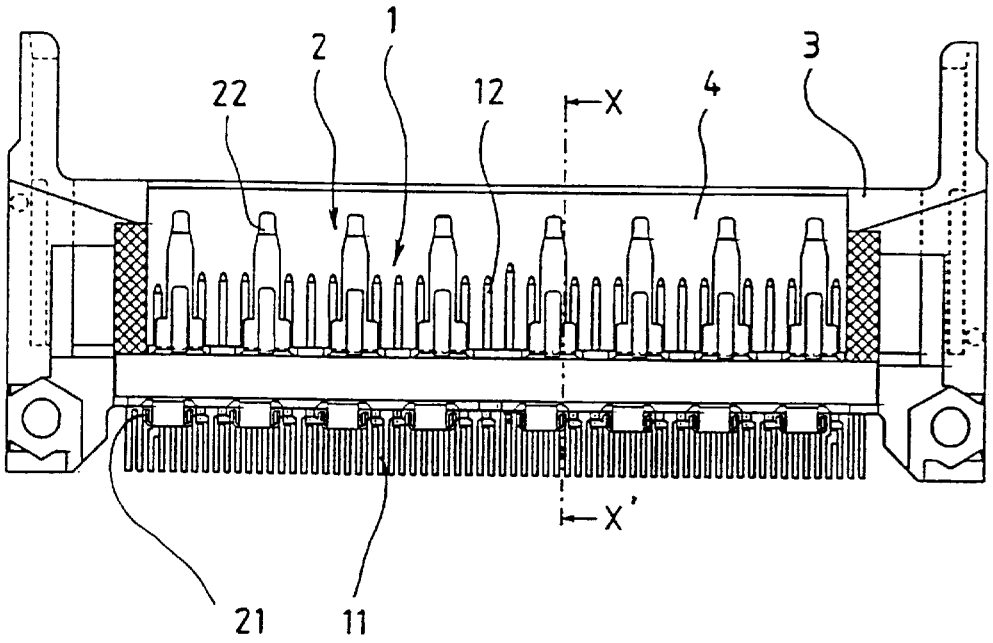
FIG. 1 is a top plan view showing the construction of an electrical connector assembly having signal and ground terminals according to the present invention.
Figure 2:
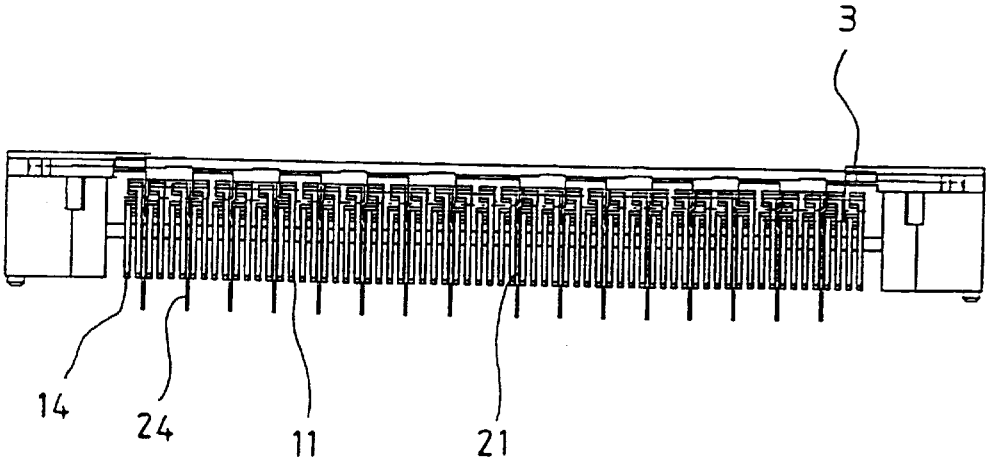
FIG. 2 is a plan view of an electrical connector assembly according to the present invention, looking from the rear of the connector assembly.
Figure 3:
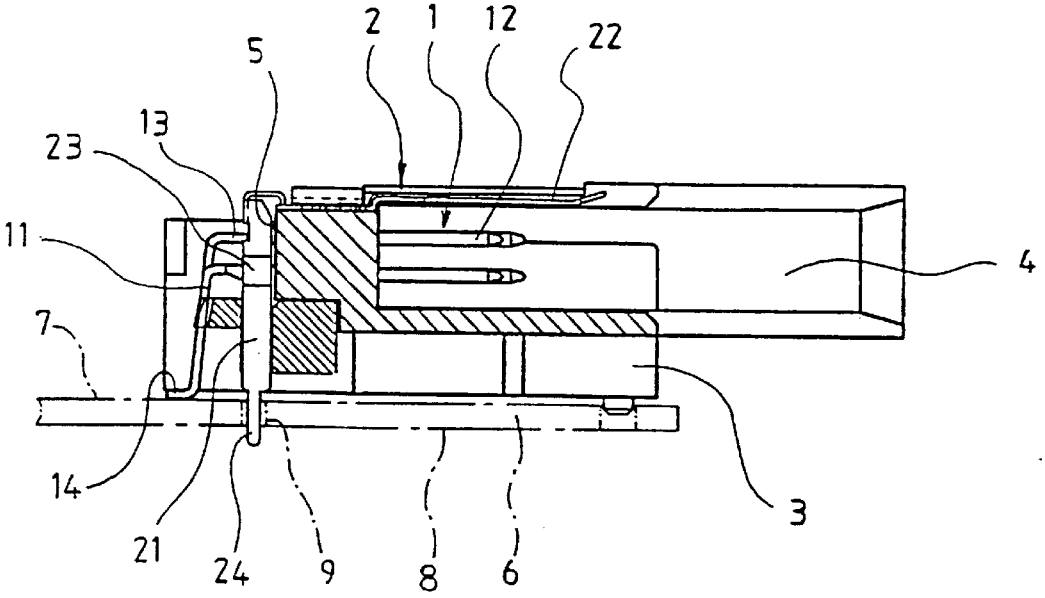
FIG. 3 is a cross-sectional view of the present invention taken generally along line X–X' of FIG. 1.

As shown in FIGS. 1, 2 and 3, an electrical connector assembly according to the present application is mounted on a printed circuit board 6 and is adapted for receiving PC cards, for example in Cardbus applications. The electrical connector assembly comprises a housing 3 provided with signal terminals 1 and ground terminals 2. Each of the signal terminals 1 and the ground terminals 2 includes a mating end positioned in or proximate an insertion space 4 of housing 3 having contact portions 12, 22, respectively, for contacting the card, and a mounting end with tail portions 11, 21, respectively, adapted to be solder connected to conductors (not shown) on the underlying printed circuit board 6.

Each of the tail portions 11 of signal terminals 1 includes an extending portion 13 extending from a rear end 5 of the housing 3 toward the circuit board and terminating in a mounting portion 14 which makes contact with a surface 7 of circuit board 6 and forms at least one row, as shown in FIGS. 1 and 3.

Figure 4:
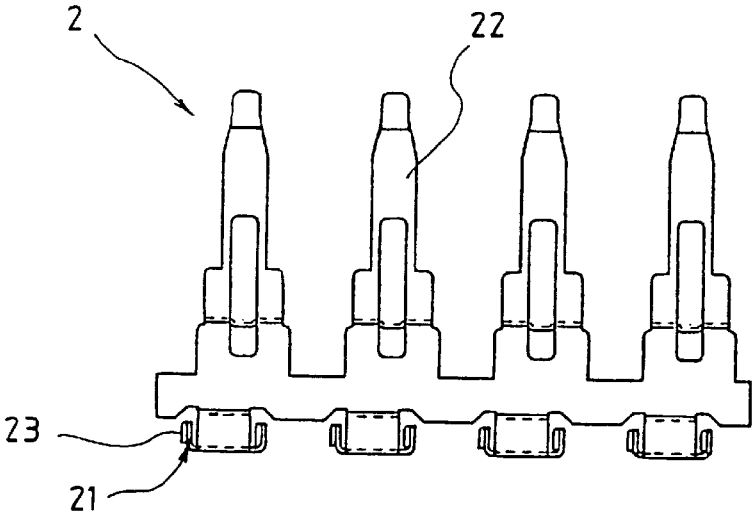
FIG. 4 is a top plan view of the invention showing the ground terminals.
Figure 5:
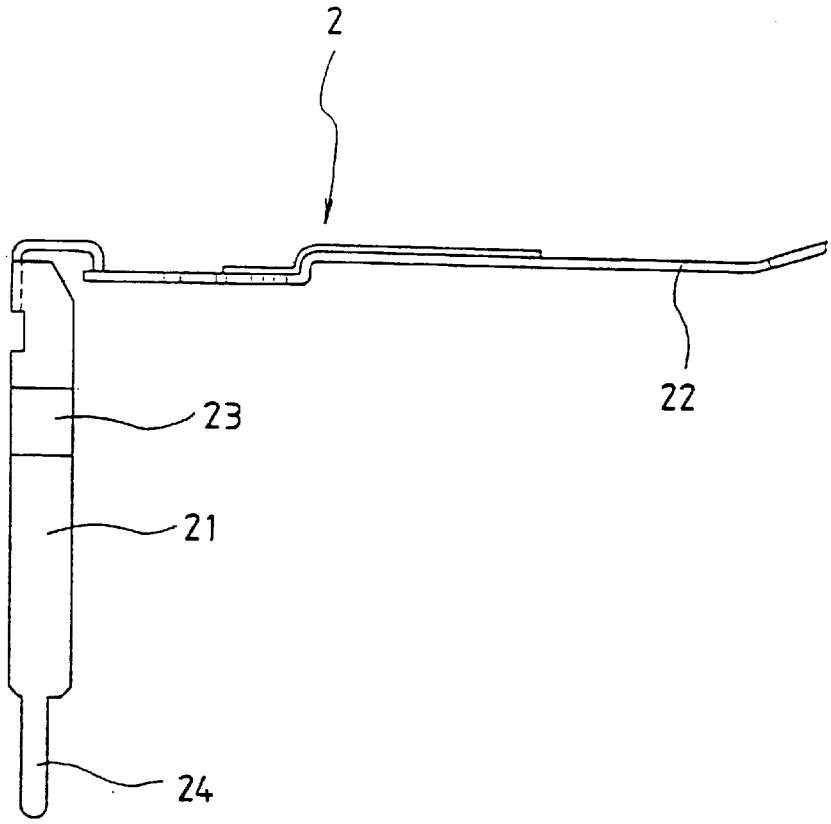
FIG. 5 is a right elevational view of the ground terminals of FIG. 4.
Figure 6:
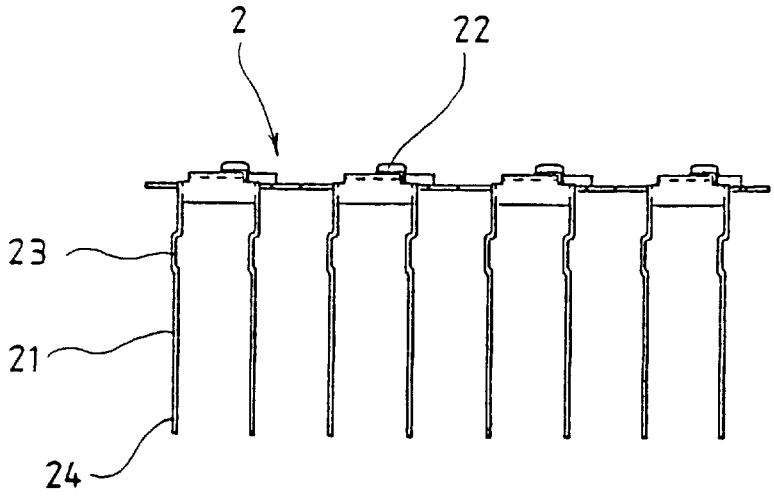
FIG. 6 is a left elevational view of the ground terminals of FIG. 5.

The ground terminals, in the form of a unitary stamped and formed ground shroud, is shown removed from the connector assembly in FIGS. 4 through 6 for ease of understanding and identification of features. Each of the tail portions 21 of ground terminals 2 extends from an upper portion of housing 3 toward the surface 7 of printed circuit board 6 and is positioned between adjacent extending portions 13 of signal terminals 1. The tail portions 21 of ground terminals 2 are dip-solder or through-hole type and further include a mounting or tip portion 24 that is inserted into a through-hole 9 in circuit board 6 (FIG. 3). A recessed portion 23 is provided on the portion of ground terminal tail portion 21 that passes between adjacent extending portions 13 of signal terminal tail portions 11 in order to avoid contact with the signal terminal tail portions.

Tail portions 21 of ground terminal 2 extend to the board between extending portions 13 of signal terminals 1, such that the at least one row of tail portions 21 of ground terminals 2 are positioned between tail portions 11 of signal terminals 1 and rear end 5 of housing 3 (FIG. 3). In other words, tail portions 11 of signal terminal 1 are positioned outside or rearward of tail portions 21 of ground terminals 2 so that inspection of the solder joints of surface mount tail portions 11 of signal terminals 1 is performed by inspecting (visually or otherwise) the upper or mounting surface 7 of circuit board 6.

Furthermore, ground terminals 2 are mounted in the form of the unitary shield on an upper portion of housing 3 so that the entire electrical connector assembly, including the signal and ground terminals, is configured to be assembled onto printed circuit board 6 in one step. The positioning of the ground terminal on the upper portion of the housing facilitates automated assembly since the assembly of all component parts from a generally vertical direction allows a robot to automatically place the parts on a mounting surface such as a circuit board in different horizontal locations.

The soldering of surface mount tail portions 11 of signal terminals 1 and the soldering of through-hole style tail portions 21 of ground terminals 2 can be performed simultaneously by a reflow soldering method, thus improving the productivity and efficiency of mounting the electrical connector assembly to the printed circuit board.

The tail portion 21 of ground terminal 2 is in the form of dip (or through-hole) soldering so that the inspection of the solder joints of tail portions 21 of ground terminals 2 is performed on the underside or back surface 8 of the printed circuit board 6.

Accordingly, it is possible to inspect the solder joints of each of the tail portions 11 of signal terminals 1 and each of the tail portions 21 of ground terminal 2 without visual or physical interference between the rows of tail portions of the signal terminals and the ground terminals.

Furthermore, since tail portions 11 of signal terminals 1 are in the form of surface mount terminals and tail portions 21 of the ground terminals 2 are in the form of through-hole terminals, the geometry of mounting portions 14 of surface mount tail portions 11 of signal terminals 1 is not affected by tail portions 21 of ground terminals 2.

The possibility of variation in position, connection failure by shorting or other assembly-related issues are avoided when the subject electrical connector assembly is mounted and soldered on the printed circuit board 6 in a single step. This configuration thereby results in improved productivity and efficiency in mounting the connector assembly to the circuit board.

Although the invention has been illustrated and described with respect to the exemplary embodiment thereof, it should be understood by those skilled in the art that changes, omissions and additions may be made therein and thereto, without departing from the spirit and scope of the invention. Therefore, the present invention should be understood as not limited to the specific embodiment set out above but to include all possible embodiments and equivalents thereof which can be embodied within the scope encompassed with respect to the features set out in the appended claims.

I claim:

1. An electrical connector assembly for mounting to a printed circuit board (6) comprising:

a housing (3) having a forward mating end for receiving a PC card and a rear end (5);

a plurality of signal terminals (2) mounted in the housing, each signal terminal including a contact portion (12) for contacting the card and a surface mount tail portion (11) adapted to be solder connected to conductors on the circuit board, the surface mount tail portion (11) having an extending portion (13) extending from the rear end of the housing and a mounting portion (14) adapted to make contact with a surface (7) of the circuit board; and a plurality of ground terminals (2) mounted on the housing, each ground terminal including a contact portion (22) for contacting a portion of the card and a through-hole tail portion (21) adapted to be solder connected to conductors of the circuit board, the through-hole tail portion (21) extending toward the circuit board (6) and having a tip portion (24) adapted to be inserted into a hole in the circuit board (6), wherein the through-hole tail portions of the ground terminals extend to the circuit board between adjacent extending portions of the surface mount tail portions of the signal terminals, said surface mount tail portions (11) of said signal terminals (1) forming a single row of surface mount tail portions, and said through-hole tail portions (21) of said ground terminals (2) forming a single row of through-hole tail portions, wherein the single row of through-hole tail portions is positioned between the single row of surface mount tail portions and said rear end (5) of said housing.

2. The electrical connector assembly as set forth in claim 1, wherein the through-hole tail portion of the ground terminal includes a recessed portion (23) located on a portion of the tail portion so as to avoid contact with an adjacent signal terminal tail portion (11).

3. The electrical connector assembly as set forth in claim 1, wherein the ground terminals are in the form of a unitary stamped and formed ground shroud mounted on an upper surface of the housing (3).

4. The electrical connector assembly as set forth in claim 1, wherein the surface mount tail portions and the through-hole tail portions are adapted to be reflow soldered to the underlying circuit board simultaneously, and the solder joints of the surface mount tail portions (11) can be inspected from the upper surface (7) of the printed circuit board and the solder joints of the through-hole tail portions (21) can be inspected from an opposite surface (8) of the printed circuit board (6).

* * * * *